US010132288B2

(12) United States Patent
Joos et al.

(10) Patent No.: US 10,132,288 B2
(45) Date of Patent: Nov. 20, 2018

(54) METHOD AND CONTROL UNIT FOR SETTING A TEMPERATURE OF A GLOW PLUG

(75) Inventors: Sascha Joos, Dresden (DE); Eberhard Janzen, Eberdingen (DE); Harald Ryll, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 616 days.

(21) Appl. No.: 14/001,072

(22) PCT Filed: Feb. 9, 2012

(86) PCT No.: PCT/EP2012/052212

§ 371 (c)(1),
(2), (4) Date: Nov. 12, 2013

(87) PCT Pub. No.: WO2012/113653

PCT Pub. Date: Aug. 30, 2012

(65) Prior Publication Data

US 2014/0054279 A1 Feb. 27, 2014

(30) Foreign Application Priority Data

Feb. 22, 2011 (DE) ..... 10 2011 004 514

(51) Int. Cl.
*F02P 19/02* (2006.01)

(52) U.S. Cl.
CPC ..... *F02P 19/021* (2013.01); *F02P 19/025* (2013.01); *F02P 19/023* (2013.01)

(58) Field of Classification Search
CPC ..... F02P 19/021; F02P 19/025
USPC ..... 219/260, 262, 263, 264, 482, 490, 494; 123/179.3, 179.5, 179.6
See application file for complete search history.

(56) References Cited

U.S. PATENT DOCUMENTS 4,285,307 A * 8/1981 Steinke ..... F02P 19/02 123/145 A
4,658,772 A * 4/1987 Auth ..... F02P 19/026 123/145 A
7,234,430 B2 * 6/2007 Toedter ..... F02D 41/064 123/179.21

(Continued)

FOREIGN PATENT DOCUMENTS

CN 101268274 A 9/2008
CN 101956640 A 1/2011

(Continued)

OTHER PUBLICATIONS

International Search Report for PCT/EP2012/052212, dated May 5, 2012.

*Primary Examiner* — Ibrahime A Abraham
*Assistant Examiner* — Justin Dodson
(74) *Attorney, Agent, or Firm* — Norton Rose Fulbright US LLP; Gerard Messina

(57) ABSTRACT

A method is described for setting a temperature of a glow plug, in particular for igniting a fuel/air mixture in an internal combustion engine in which the temperature of the glow plug is set as a function of a resistance of the glow plug with the aid of a control. To prevent temperature overshoots from occurring during the preheating phase of the glow plug, the temperature is controlled with the aid of a predictive model during a preheating phase during which an overvoltage is applied to the glow plug.

15 Claims, 3 Drawing Sheets

(56) References Cited

U.S. PATENT DOCUMENTS

| | | | | |
|---|---|---|---|---|
| 7,881,851 | B2 * | 2/2011 | Kernwein | F02P 19/026 123/145 A |
| 2006/0289457 | A1 * | 12/2006 | Baecker | B60H 1/2206 219/497 |
| 2009/0039073 | A1 * | 2/2009 | Guo | G01K 7/18 219/494 |
| 2009/0151338 | A1 * | 6/2009 | Li | F01N 3/204 60/295 |
| 2009/0316328 | A1 * | 12/2009 | Kernwein | F02P 19/025 361/264 |
| 2010/0312416 | A1 * | 12/2010 | Demirdelen | F02P 19/025 700/300 |
| 2011/0000901 | A1 * | 1/2011 | Bauer | F02P 19/025 219/494 |

FOREIGN PATENT DOCUMENTS

| | | | |
|---|---|---|---|
| DE | 102006025834 | | 12/2007 |
| DE | 102008007393 | | 8/2009 |
| DE | 102008040971 | | 2/2010 |
| EP | 0315934 | | 5/1989 |
| EP | 1298321 | A2 | 4/2003 |
| EP | 1936183 | | 6/2008 |
| JP | 61-268874 | | 11/1986 |
| JP | 61-268875 | | 11/1986 |
| JP | 64-33477 | | 2/1989 |
| JP | 1-280682 | | 11/1989 |
| JP | 6-108959 | | 4/1994 |
| JP | 2003-120932 | | 4/2003 |
| JP | 2010065661 | | 3/2010 |
| JP | 2010-531403 | | 9/2010 |

* cited by examiner

METHOD AND CONTROL UNIT FOR SETTING A TEMPERATURE OF A GLOW PLUG

FIELD OF THE INVENTION

The present invention relates to a method for setting a temperature of a glow plug, in particular for igniting a fuel/air mixture in an internal combustion engine in which the temperature of the glow plug is set with the aid of a control as a function of a resistance of the glow plug, as well as a control unit for carrying out the method.

BACKGROUND INFORMATION

Glow plugs, which are installed in internal combustion engines for igniting a fuel/air mixture, are preheated in the cold state until their temperature is high enough to be sufficient to ignite the fuel/air mixture. For this purpose, the glow plug has a heater which applies an excessively high heating voltage to the cold glow plug during a short time period of 1 to 2 seconds, so that the glow plug is overloaded at this point in time. After completion of this so-called push phase, the tip of the glow plug reaches a temperature of more than 1000° C., while the rest of the glow plug still has a temperature which is way below this temperature of 1000° C.

By activating the glow plug using an excessively high heating voltage, a temperature overshoot is produced on the glow plug. The temperature of the glow plug reached during the preheating phase represents an input variable for a control using which the temperature of the glow plug is set if same has reached a steady-state temperature characteristic. Since this input variable for the control is, however, ascertained during a transient reaction, this results in errors during the following control.

SUMMARY

An object underlying the present invention is thus to provide a method for controlling the temperature of a glow plug in which the temperature overshoot occurring during the preheating phase is reliably prevented, although the glow plug is acted on by an excessively high heating voltage.

According to the present invention, the object is achieved in that the temperature is controlled in a preheating phase of the glow plug in which an overvoltage is applied to the glow plug. The advantage of the present invention is that the glow temperature is now modulated at high quality over the entire glow process of the glow plug, and the control of the glow temperature takes place at every point in time of the glow phase, advantageously also during the preheating phase (push phase) during which the heater of the glow plug applies an excessively high heating voltage to the cold glow plug during a short time period of 1 to 2 seconds. This makes it possible to better manage the preheating phase during a key start as well as during long starting phases.

To control the temperature of the glow plug during the preheating phase, a resistance difference, which exists in relation to a measured resistance at the end of the preheating phase, is advantageously anticipatorily determined during the preheating phase with the aid of a physical model. In this way, the temperature is controlled with the aid of the predictive model during the preheating phase during which an overvoltage is applied to the glow plug. In this way, the preheating phase of the glow plug is more robust, since no or only small temperature overshoots occur and exact input values are also made available for the control of the further glow characteristic of the glow plug. Thus, the control is closely adjusted to the desirable temperature setpoint value already during the preheating phase. By determining the resistance difference, the input variable of the resistance is initialized for the control, and the point in time is also taken into account during the initial energization of the glow plug. Furthermore, the development effort is reduced, since an application for a controlled preheating is not necessary and the input parameters are determined only once and are maintained for the lifetime of the glow plug.

In one embodiment, the measured resistance of the glow plug is added to the resistance difference, and the sum formed from the measured resistance and the resistance difference is supplied to the control. In this way, the measured resistance is increased by an anticipatorily determined absolute value which corresponds to the temperature actually occurring in the glow plug during the preheating phase.

In one refinement, the resistance difference includes multiple, in particular summed up, partial resistance differences, each partial resistance difference being determined as a function of at least one operating parameter of the glow plug. In this way, the state of the glow plug is characterized at the start of a glow process during the initial energization of the glow plug and optimized by using corresponding characteristic curves.

In one variant, a first partial resistance difference is determined as a function of an energy content of the glow plug which the glow plug has at the point in time of the start of the glow process. In this way, the initial characteristic of the glow plug at the point in time of the start of the glow process is taken into account for the determination of the resistance difference.

In particular, the energy content of the glow plug is characterized by an initial resistance, an initial amount of heat, or an initial performance. Thus, the heat balance of the cold glow plug prior to the initial energization is taken into account. Since, for example, the initial resistance of the cold glow plug is very small, while the initial resistance of a glow plug which has already been preheated once is greater, it is ensured that the correct input variable is always used for the determination of the resistance difference.

In another specific embodiment, a second partial resistance difference is determined as a function of a temperature setpoint value of the glow plug which the glow plug should have at the end of the glow process. By incorporating the temperature setpoint value, it is ensured during modeling that the end state of the glow plug in the form of the temperature setpoint value, which is to be reached and which corresponds to the temperature to be set at the end of the heating process of the glow plug following the preheating phase, is also taken into account.

Furthermore, a third partial resistance difference is determined as a function of a starting temperature of the glow plug which the glow plug has at the point in time of the start of the glow process. Since the glow plug behaves differently at different temperatures during the initial start, this starting temperature of the glow plug is also taken into account to be able to model the correct behavior of the glow plug.

In particular, the starting temperature corresponds to an ambient temperature of the glow plug at the point in time of the start of the glow process. The ambient temperature of the glow plug is easily ascertainable, since motor vehicles, in whose internal combustion engines glow plugs are installed, have an outside temperature gauge. In this way, additional hardware for determining the ambient temperature may be dispensed with.

Advantageously, a fourth partial resistance difference is determined as a function of a glow process of the glow plug which directly precedes the start of the glow process. This, in particular, accounts for the state of the glow plug which the glow plug had when the ignition of the internal combustion engine, which results in the glow plug being heated, took place, was turned off shortly after, and was reactivated within a few moments.

In one embodiment, the directly preceding glow process is characterized by its glow period or glow energy, a factor, which is multiplied by the fourth partial resistance difference and added to the resistance difference, being determined as a function of an initial resistance of the glow plug. The glow period, which corresponds to the switch-on time of the glow plug, allows conclusions to be drawn regarding how much energy is still stored in the glow plug. Depending on the degree of the starting resistance set during the preceding glow period of the glow plug, the fourth partial resistance difference, which was ascertained as a function of the glow period preceding the glow process, is added to the resistance difference.

In another variant, a temperature actual value is ascertained from a characteristic curve, which is determined individually for each glow plug during the heated, steady-state operation of the glow plug, based on the sum of the measured resistance and the resistance difference, the temperature actual value being subtracted from the temperature setpoint value, the thus ascertained temperature difference being supplied to the control from which an activating voltage for the glow plug is ascertained in order to set the desired temperature setpoint value. The incorporation of the resistance difference into the determination of the temperature actual value results in a control of the temperature of the glow plug being ensured even during the rapid preheating phase.

One refinement of the present invention relates to a control unit for setting a temperature of a glow plug, in particular for igniting a fuel/air mixture in an internal combustion engine which sets the temperature as a function of a resistance of the glow plug with the aid of a control. To prevent temperature overshoots from occurring during the preheating phase, an arrangement is present which controls the temperature during a preheating phase during which an overvoltage is applied to the glow plug.

DETAILED DESCRIPTION

Cold internal combustion engines, in particular diesel engines, require a starting aid for igniting the fuel/air mixture introduced into the diesel engine in the case of ambient temperatures of <40° C. As the starting aid, glow systems are then used which include glow plugs, a glow control unit, and a glow software which is stored in an engine control unit or in the glow control unit. Moreover, glow systems are also used to improve the emissions of the vehicle. Other areas of application for the glow system are the burner exhaust gas system, the engine block heater, when preheating the fuel (flex fuel) or when preheating the cooling water.

Figure 1:
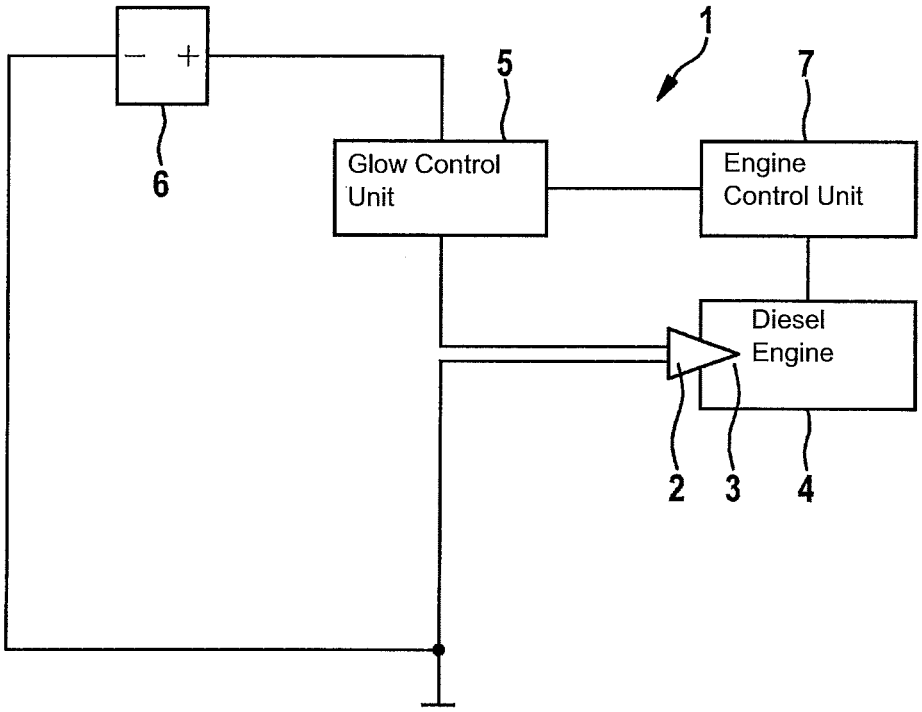
FIG. 1 shows a schematic diagram of the system of a glow plug in an internal combustion engine.

FIG. 1 shows such a glow system 1. Here, a glow plug 2 protrudes into combustion chamber 3 of diesel engine 4. Glow plug 2 is on the one hand connected to glow control unit 5 and on the other hand leads to a battery 6 which activates glow plug 2 at the nominal voltage of 11 volts, for example. Glow control unit 5 is connected to engine control unit 7 which, in turn, leads to diesel engine 4.

To ignite the fuel/air mixture, glow plug 2 is preheated by the application of an overvoltage during a preheating phase, also referred to as a push phase, which lasts for 1 to 2 seconds. The electric power which is thus supplied to glow plug 2 is converted into heat in a heater coil (not illustrated in greater detail), which is why the temperature rises rapidly at the tip of glow plug 2.

The heating power of the heater coil is adapted via electronic glow control unit 5 to the requirement of particular diesel engine 4. The fuel/air mixture is conducted past the hot tip of glow plug 2 and heats up in the process. In conjunction with an intake air heating during the compressor stroke of diesel engine 4, the combustion temperature of the fuel/air mixture is reached.

Glow plug 2 has different glow phases. As already explained above, an overvoltage, which is above the nominal voltage of glow plug 2, is supplied to cold glow plug 2 during a preheating phase which lasts for 1 to 2 seconds. During this short time period, the tip of the glow plug is heated to approximately 1000° C., while the rest of glow plug 2 is still below this temperature, whereby a non-steady-state temperature characteristic forms within glow plug 2. This preheating phase is followed by a heating phase of glow plug 2 during which the non-steady-state temperature distribution is balanced out to a steady-state temperature distribution over entire glow plug 2. Such a heating phase normally lasts for approximately 30 seconds. After the preheating phase of the glow plug, the resistance difference is dynamically adapted during the heating phase. The heating phase is followed by the glow phase during which a steady-state temperature distribution is ensured over the entire glow plug.

Figure 2:
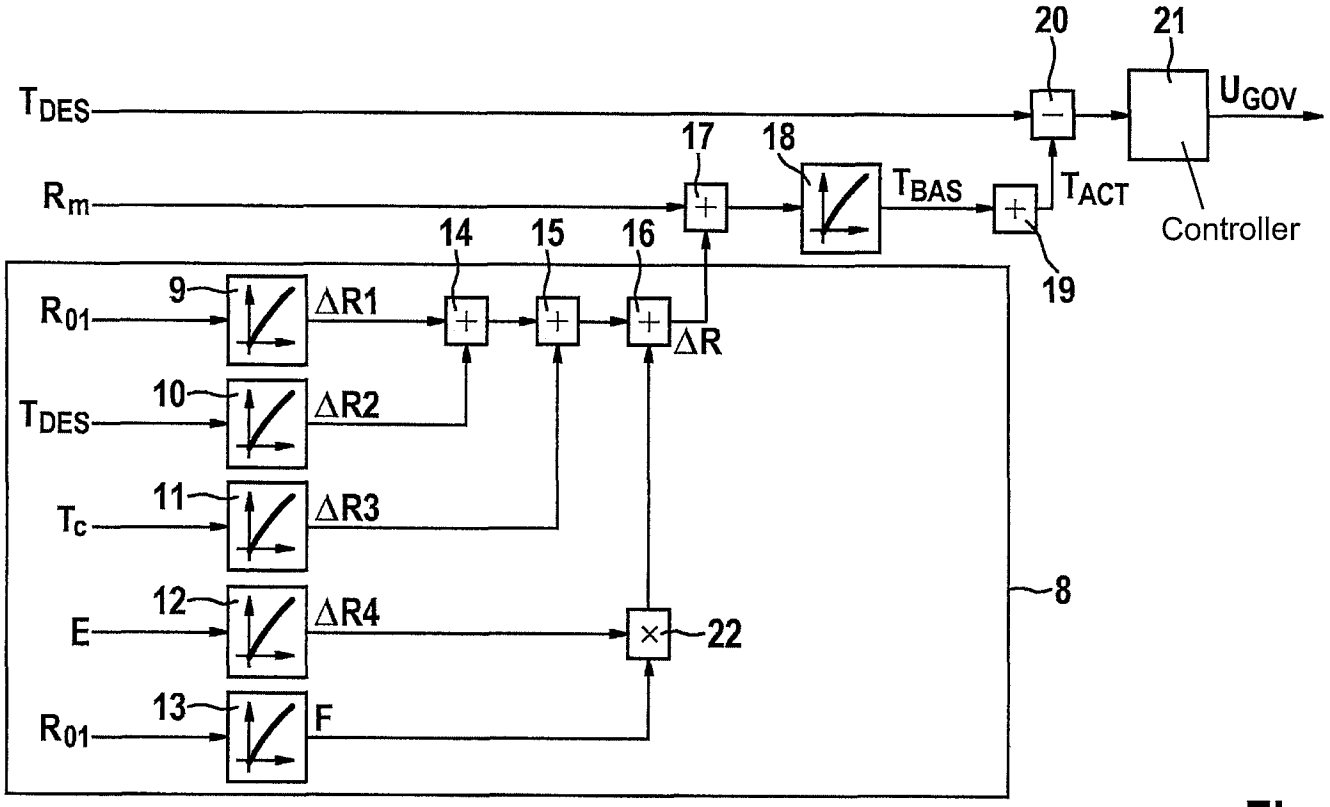
FIG. 2 shows a schematic illustration regarding the modeling of the temperature of a glow plug during a rapid preheating phase.

FIG. 2 shows a schematic diagram for temperature modeling of glow plug 2 during the rapid preheating phase which is integrated as software into engine control unit 7 or glow control unit 5 and is taken into account there in the case of a temperature control of the glow plug. A temperature setpoint value $T_{DES}$ is provided as the control input variable by engine control unit 7 for the general temperature control of glow plug 2 in the course of the entire glow process. At the same time, a resistance Rm of the glow plug is measured which represents a value for the instantaneous temperature at glow plug 2. This measured resistance Rm is determined for each energization process which takes place in consistent time intervals. In a block 17, this measured resistance Rm is added to a resistance difference ΔR which is determined with the aid of a predictive model 8. This predictive model 8 models the temperature of glow plug 2 during the rapid preheating phase. An initial resistance R01 of glow plug 2 is initially ascertained within predictive model 8. This initial resistance R01 is supplied to a characteristic curve 9 which was ascertained during the steady-state operation of the glow plug. A first partial resistance difference ΔR1 is ascertained from this characteristic curve 9 based on measured initial resistance R01.

Temperature setpoint value $T_{DES}$, which identifies the end temperature of glow plug 2 to be reached, is provided as another input variable of predictive model 8. This temperature setpoint value $T_{DES}$ is provided on another characteristic curve 10 as an input variable which is also used to ascertain a second partial resistance difference ΔR2. Partial resistance differences ΔR1 and ΔR2 thus ascertained are added in block 14.

In addition to the already mentioned input variables in the form of initial resistance R01 and of temperature setpoint value $T_{DES}$, operating temperature Tc of glow plug 2 is determined at the point in time of the start of the glow process, i.e., at point in time t=0. Third partial resistance difference ΔR3 is determined from this temperature Tc with the aid of a third characteristic curve 11. In block 15, third partial resistance difference ΔR3 is added to first and second partial resistance differences ΔR1 and ΔR2. These input variables in the form of initial resistance R01, temperature setpoint value $T_{DES}$, and operating temperature Tc are determined once at point in time t=0 upon activation of glow plug 2 and may be stored in engine control unit 7 or glow control unit 5.

To take into account that, shortly before the glow process to be carried out, glow plug 2 has already been subjected once to a glow process from which glow plug 2 has not yet sufficiently cooled down, a glow time/glow energy E (E=U*I*t) of the glow process of glow plug 2, which directly preceded the instantaneous glow process, is taken into account. A fourth partial resistance difference ΔR4 is determined from glow time/glow energy E with the aid of a fourth characteristic curve 12. Since due to glow time/glow energy E of the directly preceding glow process the resistance of glow plug 2 changes if the heat, which has built up during the preceding glow process within glow plug 2, has not yet cooled down, resistance R01 is supplied to another characteristic curve 13 which supplies as a result a factor F which is multiplied by fourth partial resistance difference ΔR4 in block 22. Factor F is selected here in such a way that it is equal to 1 if initial resistance R01, which was measured once, is greater than a predefined threshold value of resistance R01. Factor F moves towards the value zero if initial resistance R01 is lower than the predefined threshold value of resistance R01. This poses the precondition that the input variables of glow time/glow energy E having the modification of initial resistance R01, associated therewith, are only used to determine resistance difference ΔR if glow plug 2 still has a sufficiently large resistance which is accompanied by a changed temperature of glow plug 2, due to a preceding glow process. In block 16, fourth partial resistance difference ΔR4 is added to previously described partial resistance differences ΔR1, ΔR2, and ΔR3, resulting in a resistance difference ΔR which corresponds to a predetermined temperature which occurs at the end of the preheating process at glow plug 2.

In block 17, resistance difference ΔR, determined in predictive model 8, is added to measured resistance Rm. This sum of resistance difference ΔR and measured resistance Rm is supplied to a characteristic curve 18 in which the resistance is plotted against the temperature. This characteristic curve 18 is a characteristic curve ascertained individually for each glow plug 2 in the case of a steady-state temperature distribution, since glow plugs have discrete transfer functions due to production tolerances. A basis temperature TBAS of glow plug 2 is ascertained from this resistance/temperature characteristic curve 18. In block 19, this basis temperature TBAS is aligned with a heat conduction model in which it is taken into account to what extent there is a temperature difference between the inside of the heater of glow plug 2 and the surface temperature of glow plug 2. In block 19, a temperature difference is supplied to basis temperature TBAS, the sum of which yields actual temperature $T_{ACT}$ of glow plug 2. This actual temperature $T_{ACT}$ is now used in the control cycle where it is subtracted from temperature setpoint value $T_{DES}$ in block 20. The difference between temperature setpoint value $T_{DES}$ and actual temperature $T_{ACT}$ is supplied to a controller 21 which determines a voltage $U_{GOV}$ which is supplied to glow plug 2, in particular to the heater of glow plug 2, for rapidly setting temperature setpoint value $T_{DES}$.

Figure 3A:
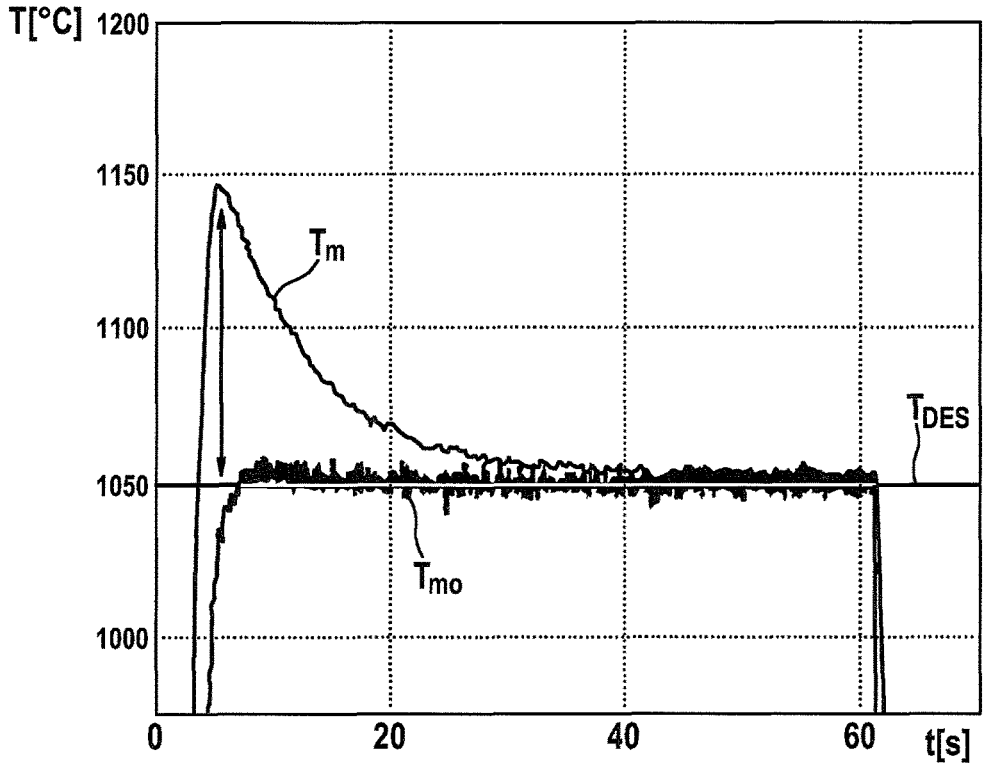
FIG. 3 shows a temperature/time diagram with and without predictive temperature modeling.
Figure 3B:
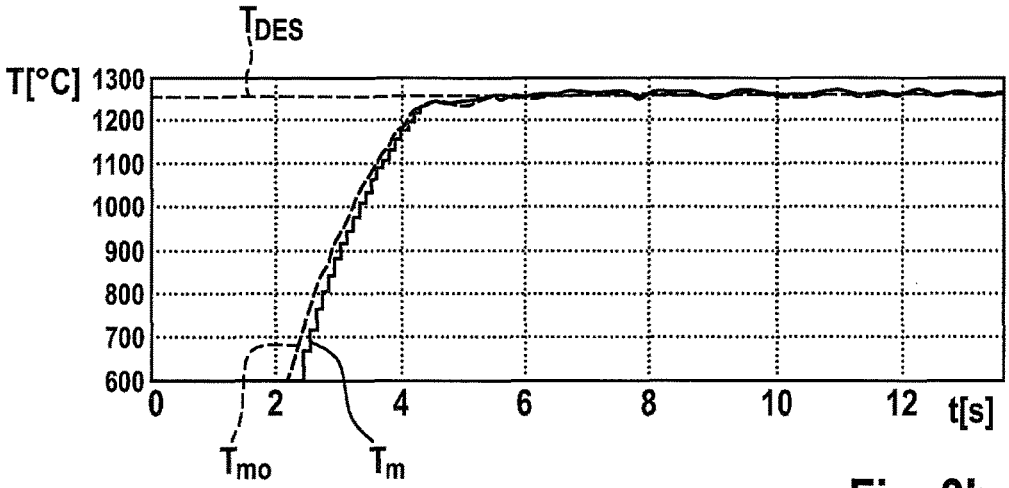

FIG. 3 shows two temperature-time diagrams in which measured temperature $T_m$ is illustrated without predictive modeling (FIG. 3*a*) and with predictive modeling (FIG. 3*b*). It is apparent from FIG. 3*a* that measured temperature $T_m$, which is to be adjusted to temperature setpoint value $T_{DES}$, has, shortly after the start of the glow process, a temperature overshoot which approaches temperature setpoint value $T_{DES}$ only after a period of approximately 30 seconds. For comparison purposes, temperature $T_{mo}$ is illustrated which is modeled mathematically according to FIG. 2 without model 8 and which reaches the level of temperature setpoint value $T_{DES}$ approximately after 5 seconds, and is controlled around this level.

In contrast, FIG. 3*b* shows the characteristic of measured temperature $T_m$ taking into account resistance difference ΔR anticipatorily determined with the aid of predictive temperature model 8. Measured temperature $T_m$ does not show a temperature overshoot, but approaches modeled temperature $T_m$ immediately after the preheating phase. With the aid of this control, temperature setpoint value $T_{DES}$ is reached already after approximately 4 seconds and is controlled around this level.

Due to predictive model 8, it is possible that a temperature control of glow plug 2 may occur not only during the steady-state operation, during which fluctuations between the resistance and temperature no longer occur, but also during the non-steady-state operation, preferably during the rapid preheating phase at the start of the glow process and during the heating phase. During the temperature modeling of glow plug 2 in the rapid preheating phase, it is modeled how large resistance difference ΔR will be at the end of the preheating process, this resistance difference ΔR being supplied to the control process as an input variable.

What is claimed is:

1. A method for controlling a temperature of a glow plug during a preheating phase of a glow process, the method comprising:

measuring a resistance of the glow plug during the preheating phase, wherein a voltage is applied to the glow plug during the preheating phase that is greater than a voltage applied during a steady state operation of the glow plug;

determining, using a physical model, a resistance quantity, representing a resistance difference between the measured resistance and a resistance of the glow plug at an end of the preheating phase, as a function of one or more inputs to the physical model, the determining including providing the one or more inputs to one or more corresponding characteristic curves implemented by the physical model, the one or more inputs including a temperature of the glow plug at a start of the glow process;

adding the measured resistance to the determined resistance quantity to produce a sum;

ascertaining an actual temperature value of the glow plug during the preheating phase based on the sum of the measured resistance and the determined resistance quantity, the ascertaining including providing the sum of the measured resistance and the determined resistance quantity as an input to a characteristic curve of a temperature of the glow plug as a function of a resistance of the glow plug during steady state operation;

subtracting the actual temperature value from a temperature setpoint value to produce a temperature difference;

supplying a voltage signal to the glow plug during the preheating phase, the voltage signal based on the temperature difference; and controlling and regulating a heater coil of the glow plug using the voltage signal, to heat the glow plug to the temperature setpoint value.

2. The method as recited in claim 1, wherein the method is for igniting a fuel and air mixture in an internal combustion engine.

3. The method as recited in claim 1, wherein:

the resistance quantity is based on multiple partial resistance quantities, each partial resistance quantity being determined as a function of at least one operating parameter of the glow plug by providing the at least one operating parameter as at least one input to at least one corresponding characteristic curve implemented by the physical model.

4. The method as recited in claim 3, wherein the resistance quantity is a sum of the multiple partial resistance quantities.

5. The method as recited in claim 3, further comprising:

determining a first partial resistance quantity as a function of an energy content of the glow plug at the start of the glow process by providing the energy content as an input to a corresponding characteristic curve implemented by the physical model.

6. The method as recited in claim 5, wherein the energy content of the glow plug includes one of an initial resistance, an initial amount of heat, and an initial performance of the glow plug.

7. The method as recited in claim 5, further comprising:

determining a second partial resistance quantity as a function of the temperature setpoint value of the glow plug for the glow process by providing the temperature setpoint value as an input to a corresponding characteristic curve implemented by the physical model.

8. The method as recited in claim 7, further comprising:

determining a third partial resistance quantity as a function of the temperature of the glow plug at the start of the glow process by providing the temperature of the glow plug at the start of the glow process as an input to a corresponding characteristic curve implemented by the physical model.

9. The method as recited in claim 8, wherein the temperature of the glow plug at the start of the glow process corresponds to an ambient temperature of the glow plug at the start of the glow process.

10. The method as recited in claim 8, further comprising:

determining a fourth partial resistance quantity as a function of a preceding glow process of the glow plug that directly precedes the start of the glow process by providing information characterizing the preceding glow process as an input to a corresponding characteristic curve implemented by the physical model, wherein the characterizing information includes at least one of: a glow period, or a glow energy; and determining a factor that is multiplied against the fourth partial resistance quantity as a function of an initial resistance of the glow plug by providing the initial resistance of the glow plug as an input to a corresponding characteristic curve implemented by the physical model.

11. The method as recited in claim 1, further comprising determining the characteristic curve individually for the glow plug during the steady-state operation of the glow plug.

12. The method as recited in claim 1, wherein the determined resistance quantity is static during the preheating phase.

13. The method as recited in claim 1, further comprising determining the resistance quantity as a function of the temperature setpoint value by providing the temperature setpoint value as an input to a corresponding characteristic curve implemented by the physical model.

14. The method as recited in claim 1, the determining further including producing one or more corresponding outputs from the one or more corresponding characteristic curves, and then combining the one or more corresponding outputs to produce the resistance quantity.

15. The method as recited in claim 14, wherein the ascertaining further includes producing the actual temperature value of the glow plug during the preheating phase as an output from the characteristic curve of the temperature of the glow plug.

* * * * *